US008272364B2

(12) United States Patent
Hausler et al.

(10) Patent No.: US 8,272,364 B2
(45) Date of Patent: Sep. 25, 2012

(54) IMPLEMENT HAVING ROTATIONAL SPEED REDUCTION AND OPERATING METHOD THEREFOR

(75) Inventors: Wolfgang Hausler, Munich (DE); Helmut Braun, Bergkirchen (DE)

(73) Assignee: Waeker Neuson Produktion GmbH & Co. KG, Munich (DE)

( * ) Notice: Subject to any disclaimer, the term of this patent is extended or adjusted under 35 U.S.C. 154(b) by 377 days.

(21) Appl. No.: 12/672,162

(22) PCT Filed: Aug. 26, 2008

(86) PCT No.: PCT/EP2008/006989

§ 371 (c)(1),
(2), (4) Date: Feb. 4, 2010

(87) PCT Pub. No.: WO2009/043414

PCT Pub. Date: Apr. 9, 2009

(65) Prior Publication Data

US 2011/0220060 A1 Sep. 15, 2011

(30) Foreign Application Priority Data

Sep. 28, 2007 (DE) ..... 10 2007 046 603

(51) Int. Cl.
*F02D 11/02* (2006.01)
*F02D 11/04* (2006.01)

(52) U.S. Cl. ..... 123/396; 123/400; 123/398

(58) Field of Classification Search ..... 123/319, 123/395, 396, 398, 400
See application file for complete search history.

(56) References Cited

U.S. PATENT DOCUMENTS

| | | | | |
|---|---|---|---|---|
| 2,677,360 | A | 5/1954 | Maurer | |
| 3,241,622 | A | 3/1966 | Ottosson et al. | |
| 5,984,027 | A | 11/1999 | Kato | |
| 6,039,024 | A * | 3/2000 | Carlson et al. | 123/396 |
| 7,926,690 | B1 * | 4/2011 | Tippmann, Sr. | 227/10 |
| 7,950,366 | B2 * | 5/2011 | Arai et al. | 123/376 |
| 2002/0088431 | A1 * | 7/2002 | Dahlberg et al. | 123/400 |
| 2006/0130809 | A1 * | 6/2006 | Wetor et al. | 123/376 |
| 2011/0073631 | A1 * | 3/2011 | Tippmann, Sr. | 227/10 |

FOREIGN PATENT DOCUMENTS

| | | |
|---|---|---|
| DE | 703206 | 3/1941 |
| DE | 884928 | 7/1953 |
| DE | 6931913 | 8/1972 |
| FR | 1013668 | 8/1952 |

OTHER PUBLICATIONS

International Search Report for PCT/EP2008/006989, Dated Dec. 29, 2008.

* cited by examiner

*Primary Examiner* — Erick Solis
(74) *Attorney, Agent, or Firm* — Boyle Fredrickson, S.C.

(57) ABSTRACT

An implement comprises an internal combustion engine having a throttle valve. At least one handle, the inside of which is provided with a gas lever likewise in a pivotal manner, is attached to a housing surrounding the internal combustion engine. The minimum distance between the gas lever and the handle is defined by a stop. When the operator lifts the implement by the handle, the position of the gas lever also changes. Even when the gas lever is fully depressed, only a part-load position is achieved at the throttle valve. In this way, effective rotational speed limitation is achieved.

17 Claims, 3 Drawing Sheets

IMPLEMENT HAVING ROTATIONAL SPEED REDUCTION AND OPERATING METHOD THEREFOR

BACKGROUND OF THE INVENTION

1. Field of the Invention

The present invention relates to an implement driven by an internal combustion engine, such as an impact device, in particular a drilling or breaking hammer, a tamper, or some other device in which the operator must cause a force to act in a defined direction. In addition, the present invention relates to an operating method for such an implement.

2. Description of the Related Art

Impact devices often have a gasoline-powered internal combustion engine that drives an impact mechanism. The impact effect is transmitted to a corresponding tool in order to achieve the desired operational effect. Impact devices are predominantly used in two rotational speed ranges; a distinction is made between no-load operation and full-load operation. Full-load operation corresponds to the operating mode in which the device operates in the intended manner.

The operating mode of the internal combustion engine, and thus the distinction between no-load and full-load operation, can be selected by the operator using a gas lever housed in a handle. As long as the impact device is relieved of load, and in particular the impact mechanism is no longer loaded, for example during the displacement or lifting of the impact device from the soil, the gas lever often remains in the full-load position, because the operator continues to hold it pressed down. The throttle valve then remains fully open. In this operating state, only a slight power loss is taken from the engine. To the extent that no control measures are implemented, the engine would rotate up to its maximum rotational speed, which ultimately would be limited only by the gas dynamic behavior inside the engine. However, the achieving of the maximum rotational speed causes a reduction in the lifespan of the engine, the coupling, and the driven parts, as well as high vibrational loading and excessive noise. For this reason, it is known to limit the rotational speed using the ignition. Above the nominal rotational speed (operating rotational speed), the ignition time is displaced in the direction of a delayed ignition. If this displacement is not sufficient, the ignition is discontinued at least for some cycles. This function is stored in a characteristic curve in the ignition, and is used to limit the rotational speed.

In particular when there is a discontinuation of the ignition during individual operating cycles, uncombusted fuel is discharged to the environment through the exhaust. If, due to exhaust gas regulations, a catalytic converter is provided in the exhaust system, the uncombusted fuel collects in the catalytic converter, which can cause overheating of the catalytic converter and ultimately its destruction.

OBJECT OF THE INVENTION

The object of the present invention is to indicate an implement in which the rotational speed of an internal combustion engine is kept below a boundary rotational speed even if the operator continues to actuate a gas lever, without the occurrence of the disadvantages described above in relation to the prior art.

According to the present invention, this object is achieved by an implement as recited in Claim 1. Advantageous embodiments of the present invention are indicated in the dependent claims. In addition, an operating method for an implement is described.

An implement has an internal combustion engine having a rotational speed control device, a bearer that houses the internal combustion engine or is connected to the internal combustion engine, a holding device provided on the bearer for holding the implement, and a gas actuating element that is movable relative to the holding device for actuation by an operator and for the corresponding adjustment of the rotational speed control device. Inter alia, the rotational speed control device can have a throttle valve in the carburetor of the internal combustion engine. The bearer that accommodates the internal combustion engine, or is connected to the internal combustion engine, can be a tubular frame or a housing that is fastened to the internal combustion engine, or that at least partly surrounds the internal combustion engine. Likewise, the bearer can have a hood that at least partly surrounds the engine. The holding device provided on the bearer can for example have two handles by which the operator can hold and guide the implement. The gas actuating element movable relative to the holding device can be a gas lever provided in or on one of the handles.

According to the present invention, the holding device is movable into at least two defined positions relative to the bearer as a function of loading by the operator, a first position corresponding to a position in which the operator lifts the implement opposite to a main operating direction, and a second position corresponding to a position in which the operator presses the implement in the main operating direction. This means that two positions are distinguished, namely the standard operating position ("second position"), in which the operator holds and guides the implement by the holding device, and standardly presses it downward, and the idle position ("first position") in which the operator lifts the implement in order to move it to another work location. As a function of the loading states resulting therefrom, the holding device must assume one of the two defined positions.

The gas actuating element is movable into at least two positions as a function of an actuation by the operator, a first position corresponding to a position in which the operator does not actuate the gas actuating element, and a second position corresponding to a position in which the operator actuates the gas actuating element, pressing it against a stop if warranted. This means that in the first position the operator wishes to bring about a no-load rotation of the internal combustion engine and correspondingly does not actuate the gas actuating element. In contrast, in the second position the operator actuates the gas actuating element in order to bring the engine to a nominal rotational speed and to run it in full-load operation.

A transmission device can be provided at least on the holding device, the position of the transmission device likewise changing relative to the bearer as a function of the position of the holding device. The transmission device can for example be formed by a stop or also by some other correspondingly suitable geometry or suitable active surfaces. As is further explained below, what is important here is that the position of the holding device has an influence on the position of the gas actuating element, so that the engine rotational speed is also influenced by pushing or pulling on the holding device.

As stated, the transmission device can have a stop against which the gas actuating element is pressed in its second position, and that is provided on the holding device. Its position correspondingly likewise changes relative to the bearer as a function of the position of the holding device. Thus, when the holding device is in its first position, the stop is in a different position than when the holding device is in its second position.

Because the stop is intended to act between the holding device and the gas actuating element, an active surface must of course be present both on the holding device and on the gas actuating element. The two active surfaces then act against one another, and are together defined as a "stop."

The gas actuating element changes its position as a function of the position of the holding device, and correspondingly as a function of the position of the stop, even if the operator does not change the actuation of the gas actuating element. This means that the position of the gas actuating element changes without the operator himself having to consciously actuate the gas actuating element in a suitable manner. Solely due to the fact that the operator lifts the implement from the ground by the holding device, or presses it against the ground by the holding device, a change in the position of the gas actuating element automatically also occurs that causes a corresponding adjustment to the rotational speed control device, in particular the throttle valve in the internal combustion engine.

In this way, it can be achieved that by pressing down the holding device in the main operating direction while simultaneously actuating the gas actuating element, a full-load operation can be set, whereas solely by lifting the holding device (despite the fact that the gas actuating element continues to be actuated) the rotational speed control device, and therewith for example the throttle valve, is modified in such a way that for example a lower rotational speed is set in order to prevent the engine from increasing its rotational speed into the range of its maximum rotational speed.

If the rotational speed control device has a throttle valve, the throttle valve can be displaceable corresponding to a position of the gas actuating element relative to the bearer. Because the position of the gas actuating element relative to the bearer also changes whenever (despite the gas actuating element continuing to be pressed or actuated) the position of the holding device is changed, the throttle valve position must necessarily also change, resulting in the desired setting or limitation of the rotational speed.

As an implement, any device is suitable in which the operator essentially exerts a force in a particular direction (main operating direction). Correspondingly, the implement can be an impact device, i.e. for example a drilling or breaking hammer, a rail tamper, a parting-off grinder, or a chainsaw. The main operating direction is the direction in which the operator presses the implement.

With regard to the relative positions between the gas actuating element, the holding device, and the bearer, at least three defined states can be set through corresponding loading or actuation on the part of the operator:

In a first state, the gas actuating element is pressed forward in the main operating direction into its "second position," and the holding device is also pressed in the main operating direction into its "second position." Here, the gas actuating element assumes an extreme frontmost position, seen in the main operating direction. As a consequence, the rotational speed control device coupled to the gas actuating element, i.e. for example the throttle valve, assumes a full-load position, so that the internal combustion engine can be operated under full load.

In a second state, the gas actuating element is also pressed forward in the main operating direction, while the holding device is pressed or pulled opposite the main operating direction into its "first position." This state can for example arise if the operator, while simultaneously continuing to press down the gas actuating element, lifts the implement from the ground in order to reposition it at a different location. As a result of the action of the transmission device provided between the holding device and the gas actuating element, i.e. for example a stop, the gas actuating element now cannot assume the frontmost extreme position, but rather a position that is reduced in comparison therewith. The rotational speed control device than assumes a part-load position, so that the engine is run in part-load operation.

In a third state, the gas actuating element is relieved of load, the operator wishing to bring about thereby that the engine is run in no-load operation. In this way, the gas actuating element assumes its "first position." The holding device can be pressed opposite the main operating direction, but may also be pressed in the main operating direction. The gas actuating element then assumes a rearmost extreme position, so that the rotational speed control device is in the no-load position.

As already explained above, the rotational speed control device can have a throttle valve. However, it can also relate to other known elements for controlling the engine rotational speed, thus achieving the desired control effect.

The holding device can be pivotable relative to the bearer. In this way, a reliable and safe operation is ensured.

The gas actuating element can also be pivotable relative to the holding device in order to enable the desired relative movements.

The holding device can have at least one, but appropriately can have two, handles by which the operator holds, guides, or lifts the implement.

In a specific embodiment, the gas actuating element is situated at least partly in the interior of the handle. In this way, the gas actuating element can be integrated into the handle.

Relative to a main operating direction of the implement oriented downward toward the ground, the gas actuating element can be situated above the handle, or so as to be accessible from above. For the operator, it is then easy while grasping the handle to simultaneously press down the gas actuating element with the ball of the hand in order to actuate it. As long as the operator firmly grips the handle, he simultaneously actuates the gas actuating element without requiring further considerations or measures on the part of the operator.

The bearer can have an extension arm on which the handle and the gas actuating element are mounted so as to be pivotable relative to one another.

The extension arm can extend away from or out from the bearer. The handle and the gas actuating element can be pivotable about a pivot axle that is situated at an end of the extension arm remote from the bearer. The handle and the gas actuating element are therefore pivotably fastened externally on the bearer, i.e. for example on the housing, on a steel tube frame, or on a hood.

The stop provided between the handle and the gas actuating element defines a least distance between the handle and the gas actuating element. As explained above, the gas actuating element and the handle must be able to come into contact via the stop. Correspondingly, an active surface is provided on each, and the two active surfaces working together form the stop.

The stop can be made adjustable such that different least distances can be set ahead of time, e.g. at the manufacturer. The least distance prespecifies which part-load setting the throttle valve assumes in the above-described second state.

The change of a direction of load at the holding device can take place in sliding fashion. Thus, it is for example possible for the operator to continuously reduce the applied pressure and finally to lift the implement. In order to avoid an undefined state, it can be useful, for a change in the direction of load, to provide a fixed switching point at which the change between full-load and part-load operation takes place. Alternatively, it is also possible to realize a sliding change with a sliding rotational speed adaptation.

In addition, an operating method is indicated for an implement, the implement having an internal combustion engine with a rotational speed control device, a bearer connected to the internal combustion engine, a holding device provided on the bearer for holding the implement, and a gas actuating element for actuation by an operator and for corresponding adjustment of the rotational speed control device. The rotational speed control device assumes a full-load position when the operator actuates the gas actuating element and presses the holding device in a main operating direction. If, in contrast, the operator actuates the gas actuating element and presses or lifts the holding device opposite the main operating direction, the rotational speed control device assumes a part-load position. If the operator does not actuate the gas actuating element, the rotational speed control device assumes a no-load position.

These and further advantages and features of the present invention are explained in more detail below on the basis of an example, with reference to the accompanying Figures.

DETAILED DESCRIPTION OF THE PREFERRED EMBODIMENT

Figure 1:
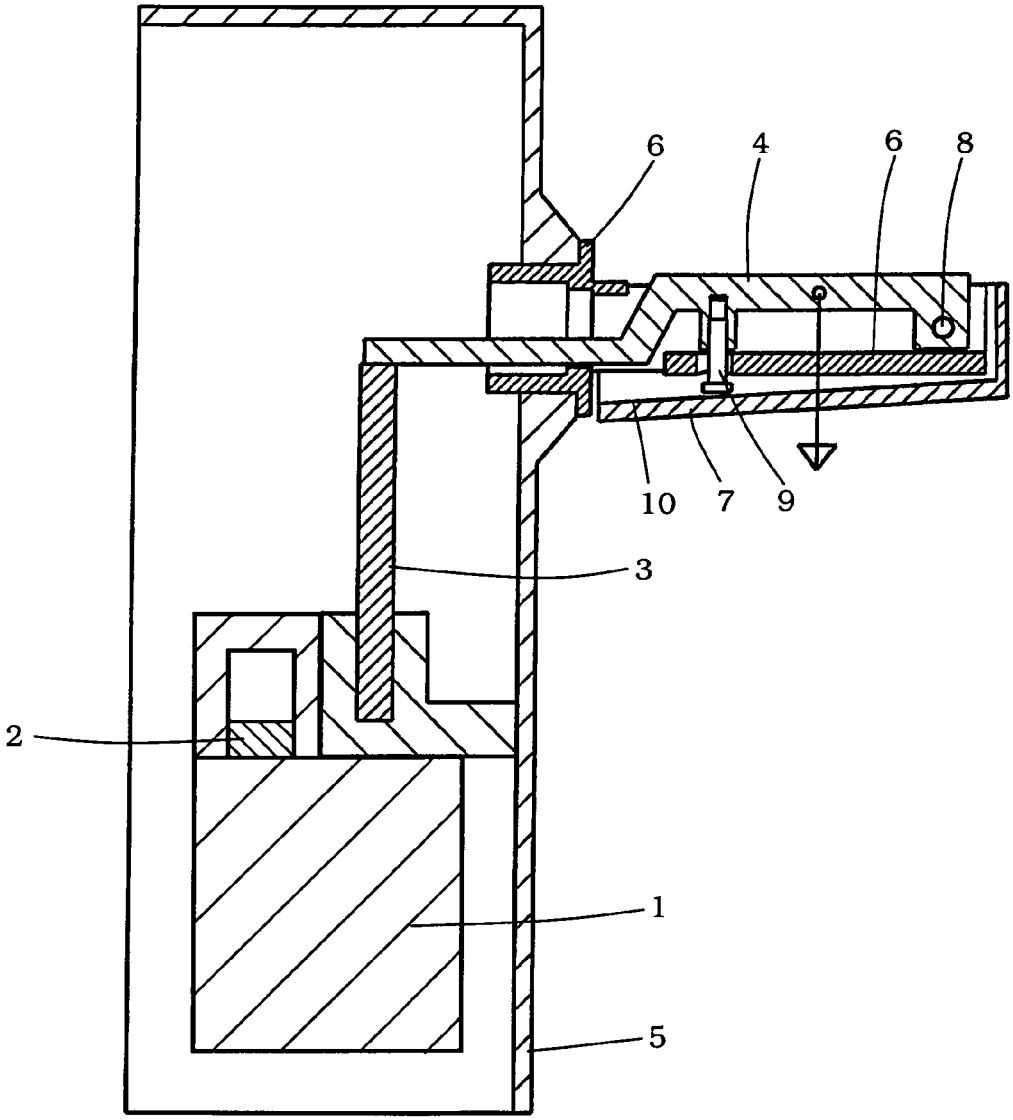
FIG. 1 shows a schematic sectional representation of a segment of an impact device, used as an implement, in a first state.
Figure 2:
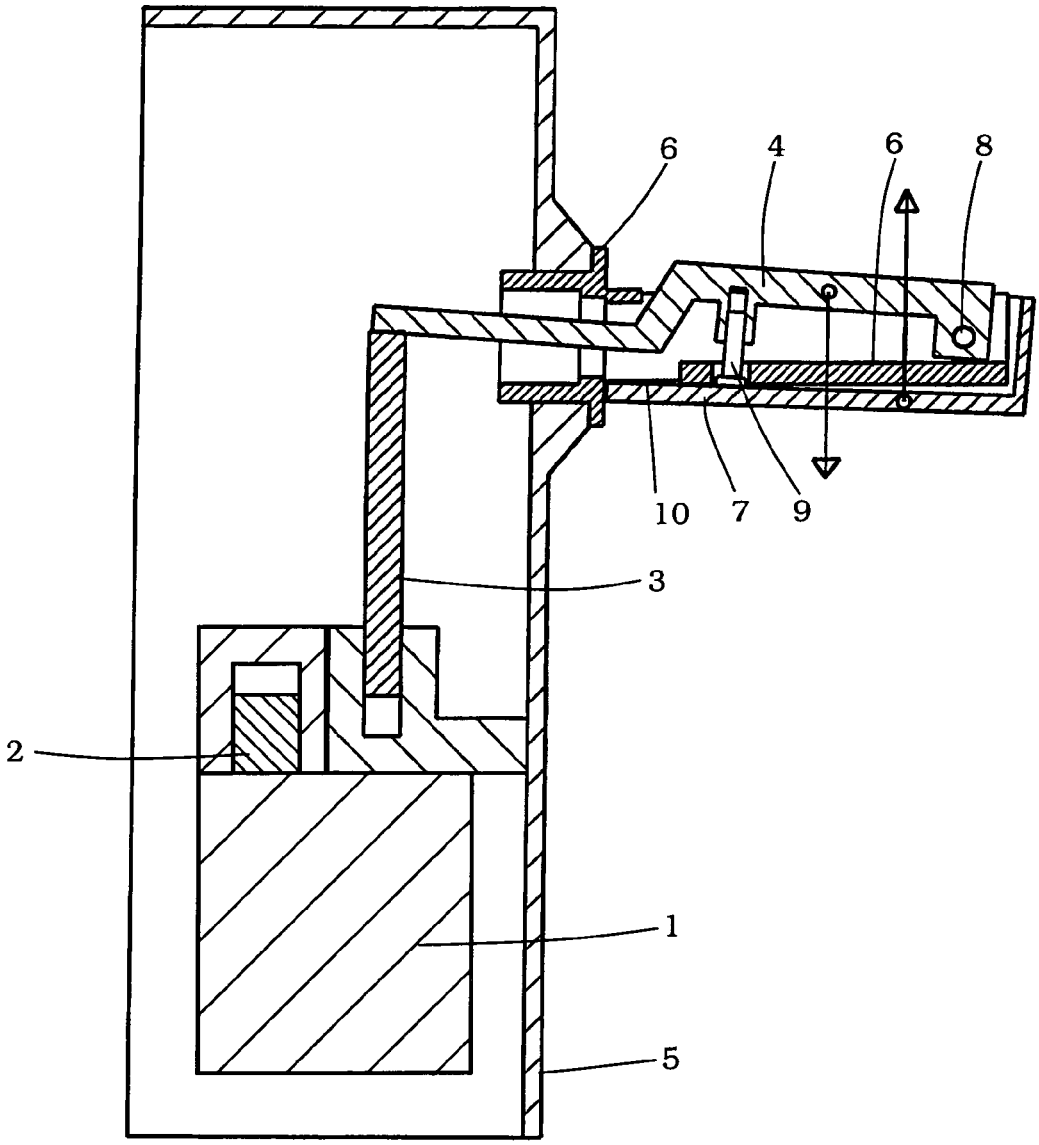
FIG. 2 shows the implement in a second state.
Figure 3:
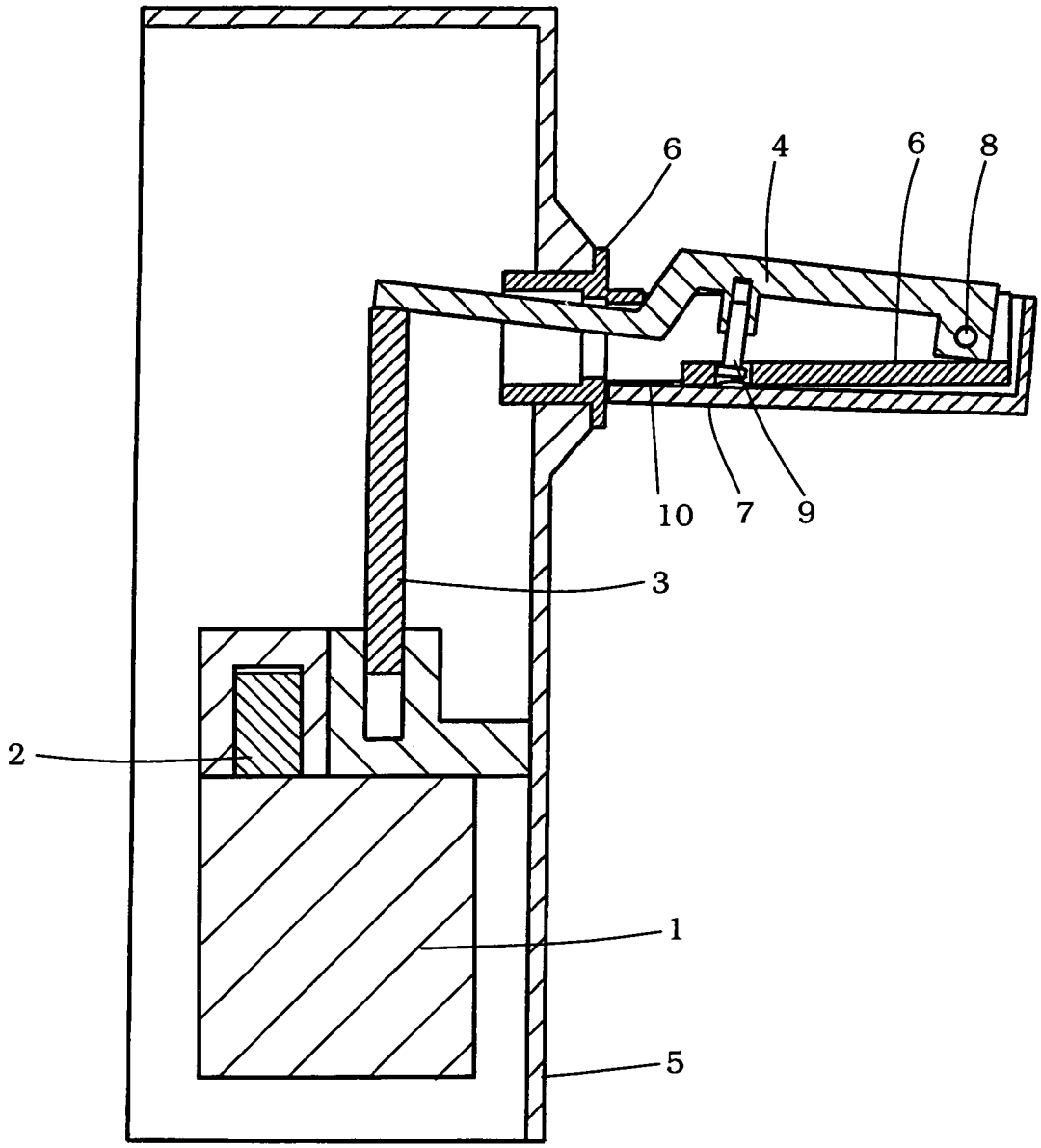
FIG. 3 shows the impact device in a third state.

FIGS. 1 through 3 each show a schematic representation of a gasoline-operated breaking hammer, or a rail tamper, as an impact device, in a lateral sectional representation in various operating states. Parts of the device are shown only schematically.

The impact device is driven by an internal combustion engine 1, shown only symbolically, that charges an impact mechanism that is not shown. Internal combustion engine 1 has a rotational speed control device having a throttle valve 2. Throttle valve 2 is also shown only schematically. However, its functioning has long been known in the prior art, so that further description is unnecessary.

The position of throttle valve 2 can be adjusted between a fully open position, corresponding to a full-load or full-gas operating mode (FIG. 1) through a part-load position (partly open, FIG. 2) to a no-load position (largely closed, FIG. 3).

The adjustment of throttle valve 2 takes place using a rod or Bowden cable 3 that transmits the actuating movement of a gas lever 4 to throttle valve 2. At gas lever 4, an operator can use suitable actuation to select which position throttle valve 2 should assume, and thus which rotational speed the internal combustion engine should assume.

The internal combustion engine, as well as standard further aggregates such as the percussion mechanism, are enclosed by a housing 5 that acts as a bearer. Housing 5 can accordingly also be formed by a tube or plate bearer. Housing 5 can enclose the internal combustion engine and/or the impact mechanism entirely or partly. Thus, there is a specific embodiment in which housing 5 encloses the internal combustion engine only partly, in the manner of a hood.

An extension arm 6 extends laterally from housing 5. Standardly, two extension arms 6 are provided that extend away from housing 5 at opposite sides. A handle 7 by which the operator can hold and guide the impact device is attached to each extension arm 6. Handle 7 is movable, about a pivot axle 8, into at least two positions relative to extension arm 6, as is shown in FIGS. 1 and 2.

Likewise, gas lever 4 is movable relative to extension arm 6, and thus to housing 5, internal combustion engine 1, and throttle valve 2, about pivot axle 8. The movement of gas lever 4 is communicated to throttle valve 2 via Bowden cable 3 in each case.

Between gas lever 4 and handle 7 there is provided a stop screw 9 that is part of a transmission device. Stop screw 9 can be screwed into gas lever 4 with varying depth. Its screw head works together with a stop surface 10 on handle 7. Thus, stop screw 9 and stop surface 10 form an effective stop, acting as a transmission device, between gas lever 4 and handle 7 in order to define a least distance.

The screw-in depth of stop screw 9 is adjustable in order to realize a differing least distance or minimum distance between gas lever 4 and handle 7. In this way it is possible already at the factory to prespecify a defined relative position that then corresponds to the part-load position that arises later during operation.

In the following, three different operating states of the impact device are explained on the basis of FIGS. 1 through 3.

FIG. 1 shows a first operating state in which the operator holds the impact device in the operating position, i.e. substantially vertically downward, while pressing gas lever 4 downward. As a consequence, not only is gas lever 4 pivoted downward into its extreme position, but handle 7 is also situated in its lowermost position. Correspondingly, throttle valve 2 is fully open, so that internal combustion engine 1 is operated in full-load operation.

FIG. 2 shows an operating state in which the operator lifts the impact device from the ground in order to change the working position. Because the operator continues to fully grasp handle 7, handle 7 pivots upward relative to extension arm 6. At the same time, however, gas lever 4 continues to be pressed downward into its extreme possible position. However, due to the interaction between stop screw 9 on gas lever 4 and stop surface 10 on handle 7, gas lever 4 is lifted to a certain extent out of the position shown in FIG. 1, so that Bowden cable 3 changes its position by distance b. Consequently, throttle valve 2 also closes in an intended manner, so that the engine is then further operated only in part-load operation.

In practice, this means that while the operator may have continued to fully depress gas lever 4, the engine is nonetheless not operated in full-load operation. Because the lifting of the impact device generally does not demand significant power, in a conventionally designed impact device the engine would continue to increase its rotational speed up to its maximum rotational speed. However, because throttle valve position 2 is automatically modified by the interaction between handle 7 and gas lever 4, the rotational speed of the engine is automatically also adapted and can be set to a desired value, e.g. below the nominal rotational speed.

FIG. 3 shows a state in which the operator has lifted the impact device using handle 7. In addition, the operator has removed the load from gas lever 4, so that the gas lever can move into its uppermost extreme position. This position is communicated via Bowden cable 3 to throttle valve 2, resulting in no-load operation of internal combustion engine 1.

The no-load rotational speed can lie for example in a range from 1800 to 2000 min-1, while the nominal rotational speed is standardly in a range from 4200 to 4500 min-1 Depending on the design of the device, in the part-load operating mode shown in FIG. 2 an arbitrary suitable operating mode of the engine can be set. For example, the part-load rotational speed can lie in the range of the nominal rotational speed (the impact device being largely relieved of load in part-load operation). In part-load operation it can also be sought to achieve a rotational speed in the range of the no-load rotational speed. Of course, arbitrary intermediate rotational speeds may also be set. This is left to the discretion of the manufacturer.

With the aid of the impact device according to the present invention, it is possible for only a part-load setting to be achieved via throttle valve 2 even when the operator holds gas lever 4 in the fully depressed position while simultaneously lifting the impact device by handles 7. In this way, an effective rotational speed limitation is achieved.

We claim:

1. An implement, comprising:

an internal combustion engine having a rotational speed control device;

a bearer connected to the internal combustion engine;

a holding device provided on the bearer for holding the implement; and a gas actuating element that is movable relative to the holding device, for actuation by an operator and for the corresponding adjustment of the rotational speed control device; wherein:

the holding device is movable into at least two defined positions relative to the bearer as a function of a loading by the operator, a first position corresponding to a position in which the operator lifts the implement opposite a main operating direction, and a second position corresponding to a position in which the operator presses the implement in the main operating direction; wherein:

the gas actuating element is movable into at least two positions as a function of an actuation by the operator, a first position corresponding to a position in which the operator does not actuate the gas actuating element and a second position corresponding to a position in which the operator actuates the gas actuating element;

a transmission device being provided at least on the holding device, and the position of the transmission device also changing relative to the bearer as a function of the position of the holding device; and wherein:

the gas actuating element changes its position as a function of the position of the holding device and, correspondingly, the position of the transmission device, even if the operator does not change the actuation of the gas actuating element.

2. The implement as recited in claim 1, wherein, with regard to the relative positions between the gas actuating element, the holding device, and the bearer, at least three defined states can be set by the operator, namely a first state in which the gas actuating element is pressed forward in the main operating direction, the holding device is pressed in the main operating direction, the gas actuating element assumes a frontmost extreme position, the rotational speed control device coupled to the gas actuating element assumes a full-load position;

a second state in which the gas actuating element is pressed forward in the main operating direction, the holding device is pressed opposite the main operating direction, the gas actuating element does not assume the frontmost extreme position due to the transmission device, the rotational speed control device assumes a part-load position;

a third state in which the gas actuating element is relieved of load, the gas actuating element assumes a rearmost extreme position, and the rotational speed control device assumes a no-load position.

3. An implement, comprising:

an internal combustion engine having a rotational speed control device;

a bearer connected to the internal combustion engine;

a holding device, provided on the bearer, for holding the implement; and a gas actuating element that is movable relative to the holding device for actuation by an operator and for corresponding adjustment of the rotational speed control device; wherein:

the holding device is movable into at least two defined positions relative to the bearer as a function of a loading by the operator, a first position corresponding to a position in which the operator lifts the implement opposite a main operating direction, and a second position corresponding to a position in which the operator presses the implement in the main operating direction;

the gas actuating element being movable into at least two positions as a function of an actuation by the operator, a first position corresponding to a position in which the operator does not actuate the gas actuating element, and a second position corresponding to a position in which the operator actuates the gas actuating element; and in which with regard to the relative positions between the gas actuating element, the holding device, and the bearer, at least three defined states can be set by the operator, namely a first state in which the gas actuating element is pressed forward in the main operating direction, the holding device is pressed in the main operating direction, the gas actuating element assumes a frontmost extreme position, the rotational speed control device coupled to the gas actuating element assumes a full-load position;

a second state in which the gas actuating element is pressed forward in the main operating direction, the holding device is pressed opposite the main operating direction, the gas actuating element does not assume the frontmost extreme position, the rotational speed control device assumes a part-load position;

a third state in which the gas actuating element is relieved of load, the gas actuating element assumes a rearmost extreme position, the rotational speed control device assumes a no-load position.

4. The implement as recited in claim 3, wherein:

a transmission device is provided at least on the holding device, and the position of the transmission device also changes relative to the bearer as a function of the position of the holding device; and wherein:

the gas actuating element changes its position as a function of the position of the holding device and, correspondingly, the position of the transmission device, even if the operator does not change the actuation of the gas actuating element.

5. The implement as recited in claim 1, wherein:

the transmission device has a stop situated on the holding device;

the gas actuating element can be pressed against the stop in the second position; and a position of the gas actuating lever relative to the bearer can be influenced by the position of the holding device.

6. The implement as recited in claim 1, wherein:

the rotational speed control device has a throttle valve of the internal combustion engine; and the throttle valve is adjustable corresponding to a position of the gas actuating element relative to the bearer.

7. The implement as recited in claim 1, wherein:

in the first state, the throttle valve assumes the full-load position;

in the second state, the throttle valve assumes the part-load position; and wherein:

in the third state, the throttle valve assumes the no-load position.

8. The implement as recited in claim 1, wherein the holding device is pivotable relative to the bearer.

9. The implement as recited in claim 1, wherein the gas actuating element is pivotable relative to the holding device.

10. The implement as recited in claim 1, wherein the holding device is a handle.

11. The implement as recited in claim 10, wherein the gas actuating element is situated at least partly in the interior of the handle.

12. The implement as recited in claim 1, wherein the gas actuating element is situated above the handle, relative to a main operating direction of the implement that is directed downward toward the ground.

13. The implement as recited in claim 1, wherein the bearer has an extension arm on which the handle and the gas actuating element are mounted so as to be pivotable relative to one another.

14. The implement as recited in claim 13, wherein:

the extension arm extends away from the bearer; and wherein:

the handle and the gas actuating element are pivotable about a pivot axle that is situated on an end of the extension arm remote from the bearer.

15. The implement as recited in claim 1, wherein the transmission device serves to define a least distance between the handle and the gas actuating element.

16. The implement as recited in claim 1, wherein the transmission device has an adjustable element for the advance setting of different least distances.

17. An operating method for an implement, the implement comprising:

an internal combustion engine having a rotational speed control device;

a bearer connected to the internal combustion engine;

a holding device provided on the bearer for holding the implement; and a gas actuating element for actuation by an operator and for the corresponding adjustment of the rotational speed control device;

wherein the method comprises:

assuming a full-load position of the rotational speed control device when the operator actuates the gas actuating element and presses the holding device in a main operating direction;

assuming a part-load position of the rotational speed control device when the operator actuates the gas actuating element and presses the holding device opposite the main operating direction;

assuming a no-load position of the rotational speed control device when the operator does not actuate the gas actuating element.

* * * * *